United States Patent [19]

Vrzalik

[11] 4,432,353

[45] Feb. 21, 1984

[54] KINETIC TREATMENT PLATFORM

[75] Inventor: John H. Vrzalik, San Antonio, Tex.

[73] Assignee: Kinetic Concepts, Inc., San Antonio, Tex.

[21] Appl. No.: 226,118

[22] Filed: Jan. 19, 1981

[51] Int. Cl.[3] ..... A61H 1/00

[52] U.S. Cl. ..... 128/24 R; 128/70

[58] Field of Search ..... 128/24 R, 44–46, 128/51, 56, 48, 70, 71, 25 R; 5/60–66, 109; 24/211 P, 212, 219, 220, 263 B, 328; 411/341–343, 345

[56] References Cited

U.S. PATENT DOCUMENTS 3,184,816 5/1965 McCarthy ..... 24/211 R 3,434,165 3/1969 Keane ..... 128/71

4,071,916 2/1978 Nelson ..... 5/109 X 4,175,550 11/1979 Leininger et al. ..... 128/24 R 4,194,499 3/1980 Donnelly, Jr. ..... 128/24 R

*Primary Examiner*—Richard J. Apley

*Assistant Examiner*—David J. Brown

*Attorney, Agent, or Firm*—Cox & Smith Incorporated

[57] ABSTRACT

A kinetic treatment table having a lifting mechanism to allow lowering of the kinetic treatment table close to the ground support surface and having a releasable connecting means to automatically connect or release the oscillating means from the kinetic treatment table and an adjusting means to vary the degree of oscillation of the kinetic treatment table.

16 Claims, 13 Drawing Figures

KINETIC TREATMENT PLATFORM

BACKGROUND OF THE INVENTION

This invention relates generally to an apparatus for treating an immobilized patient under kinetic therapy. In particular, it relates to a kinetic treatment platform which provides controlled oscillatory movement to a bed support means having a patient disposed thereon.

It is well known in the art to provide a bed with a patient support means adapted for controlled oscillatory movement whereby a patient may be subjected to gentle alterations of position while lying on the bed support means. Beds having oscillatory patient support platforms are shown in U.S. Pat. Nos. 3,343,165 issued to F. X. Keane on Mar. 25, 1969 and U.S. Pat. No. 4,175,550 issued to James R. Leininger et al. on Nov. 27, 1979 which patents are incorporated herein in toto for any and all purposes by this specific reference thereto. The support beds of the above patents provide kinetic treatment to substantially lessen if not eliminate the problems and complications for a mobilized patient. In the case of certain patients, it is desirable to remove the patient from the bed, raise and lower the bed, or tilt the bed at a desired angle. In this connection, it is sometimes necessary to lower the bed very close to the supporting floor to facilitate removal and positioning of a patient on the platform. It is an object of this invention to provide a new and improved means whereby the bed support means for the patient may be lowered very closely to the floor supporting the bed frame. It is also desirable that the bed be easily tiltable.

It is sometimes desirable to deactivate the oscillatory mechanism of the bed whereby the patient may be fed, examined, or the like. In such case, the oscillating mechanism must be disengaged or deactivated so that the bed will remain stationary. In this connection, it is desirable to have some releasing means whereby the oscillatory mechanism can be easily disengaged and can also be easily reengaged without the necessity of a large amount of effort or assistance to effect these actions. It is an object of the invention to provide a mechanism which can be simply operated with a minimal amount of effort and safety and may be operated when the bed is in any position without waiting until the patient support means is horizontal. It is also desirable to vary the size of the arc in which the bed oscillates. It may be desirable to have the bed rotate in a large arc in certain situations and a much lessor arc in other situations depending on the mobility of the patient. In this connection, it is an object of this invention to provide a mechanism whereby the oscillating mechanism can be easily adjusted to vary the arc in which the bed oscillates.

It is sometimes desirable to raise the back of the bed to elevate the back of the patient for comfort and the like. In this connection it is desirable to prevent the bed from oscillating when the back is raised. It is one of the objects of this invention to provide a means which automatically locks the bed in its horizontal position when the back of the bed is raised. The oscillating mechanism includes a slip-clutch device which prevents injury to the oscillating mechanism when the bed support means is locked in its horizontal position and the oscillating mechanism is not deactivated or disengaged.

It is an object of the invention to provide a more efficient and improved kinetic treatment device. It is also an object to provide a device which may be economically manufactured and which is safe and reliable.

Other objects of the invention will become apparent from the following detailed description.

SUMMARY OF THE INVENTION

An oscillating kinetic treatment bed having an elevating mechanism which provides lowering of the patient support platform close to the floor level and tilting. The oscillating mechanism includes an automatic release means which will release the bed when it is in its horizontal position and which likewise can be set to reengage the oscillating mechanism with the bed patient support means. During operation the release mechanism may be deactivated in any oscillatory position of the bed but it will not disengage until the bed reaches its horizontal position. The oscillating mechanism includes an excentric adjusting means which will vary the arc in which the bed rotates. The bed further includes a locking means which automatically locks the patient support means in its horizontal position when the back supporting portion of the bed is raised.

FIG. **5*a*** shows the slip clutch mechanism.

Figure 6:
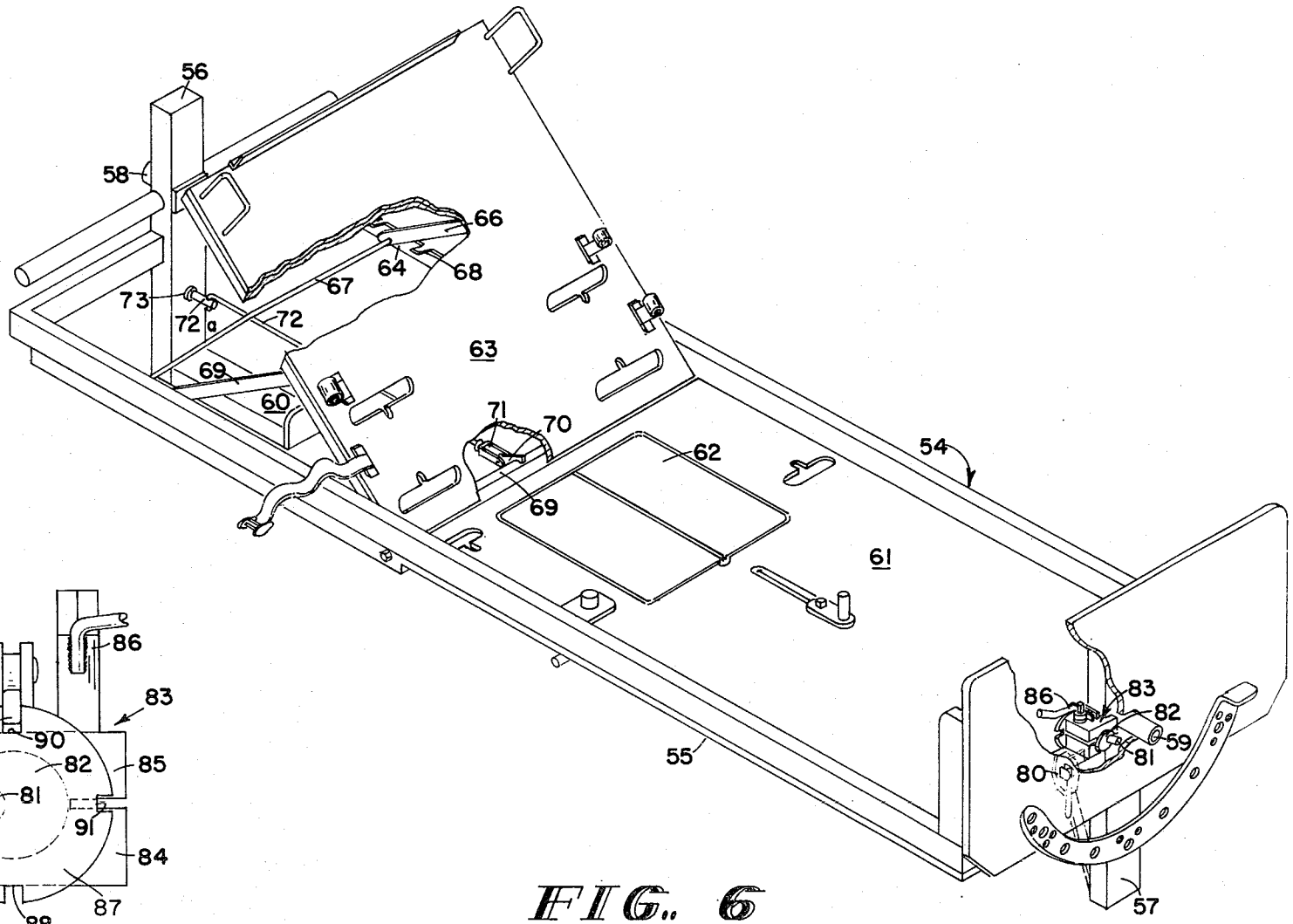

FIG. 6 shows the locking means which prevents rotation of the patient support means when the back of the patient support means is raised.

Figure 7:
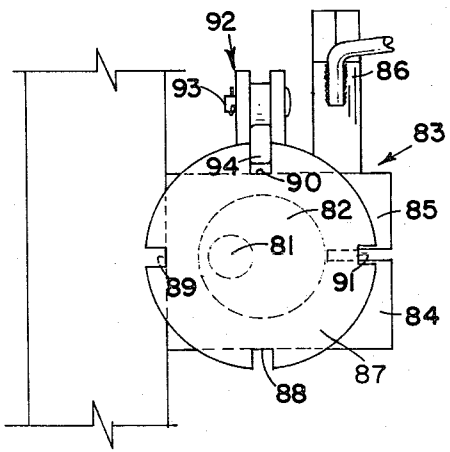

FIG. 7 shows the adjusting means which varies the arc in which the patient support means oscillates.

Figure 8:
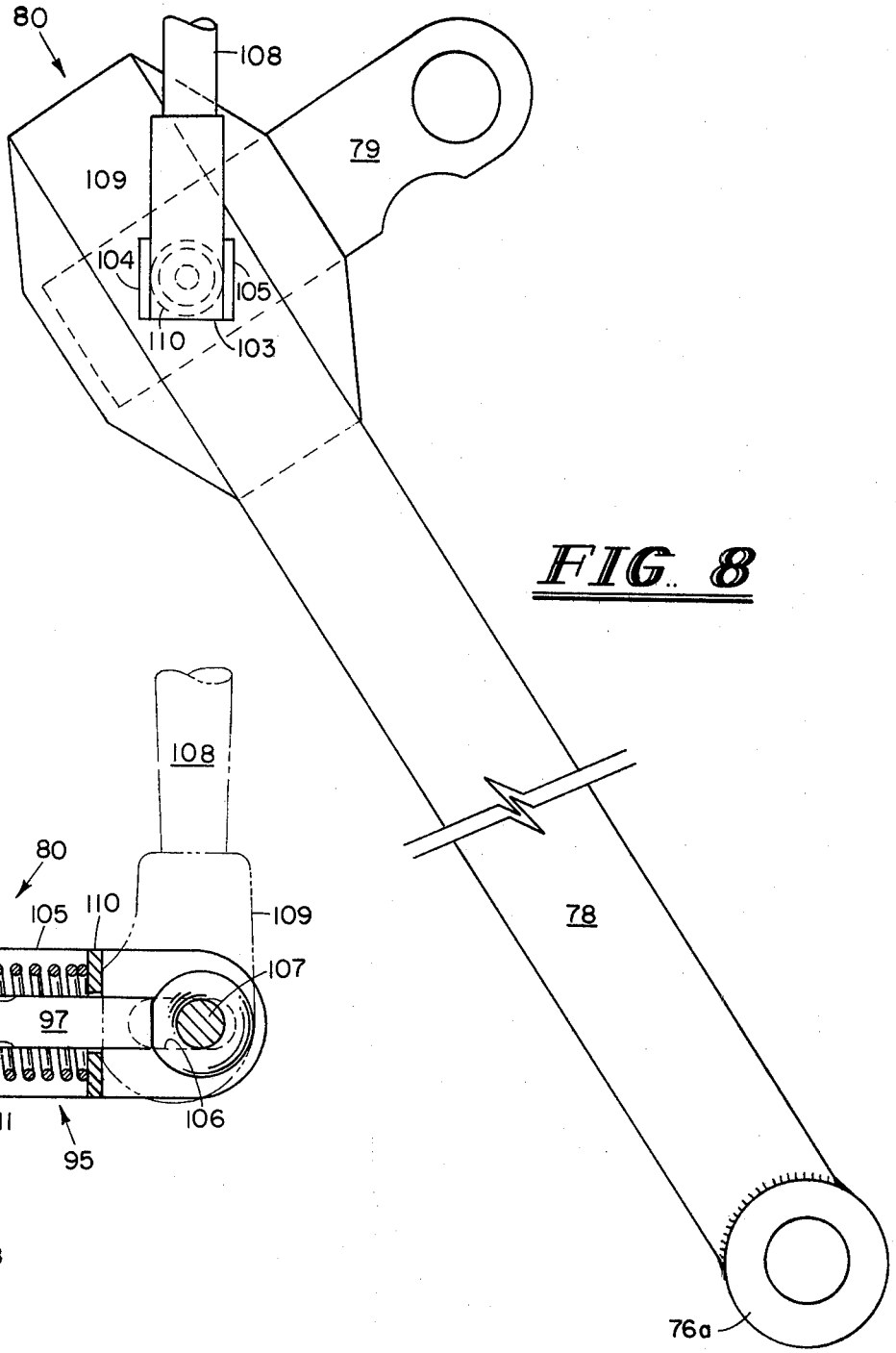

FIG. 8 is a partial view showing a portion of the oscillating mechanism of the bed.

Figure 9:
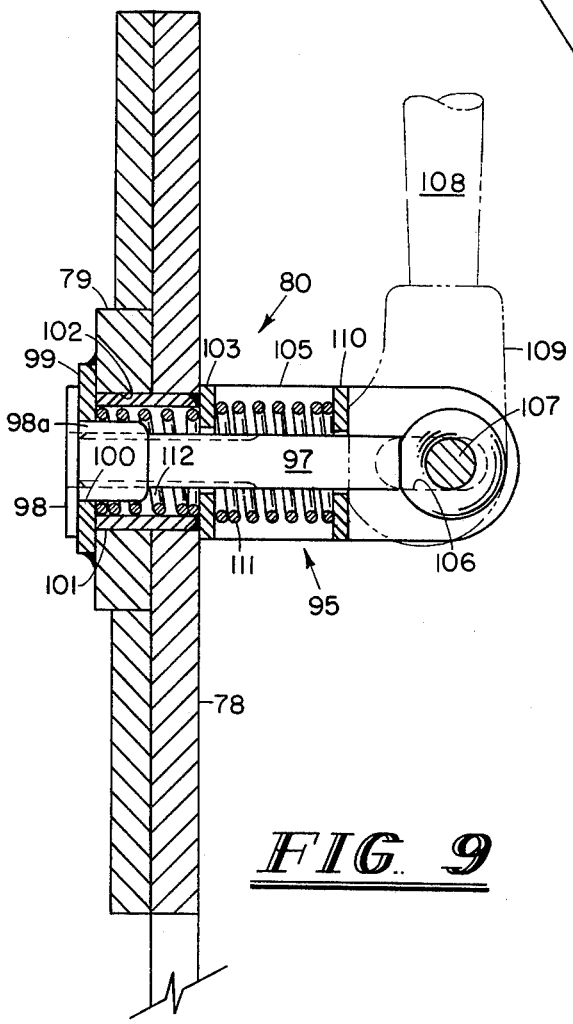

FIG. 9 is a cross-sectional side view of the releasing means of the oscillating mechanism in its locked position.

Figure 10:
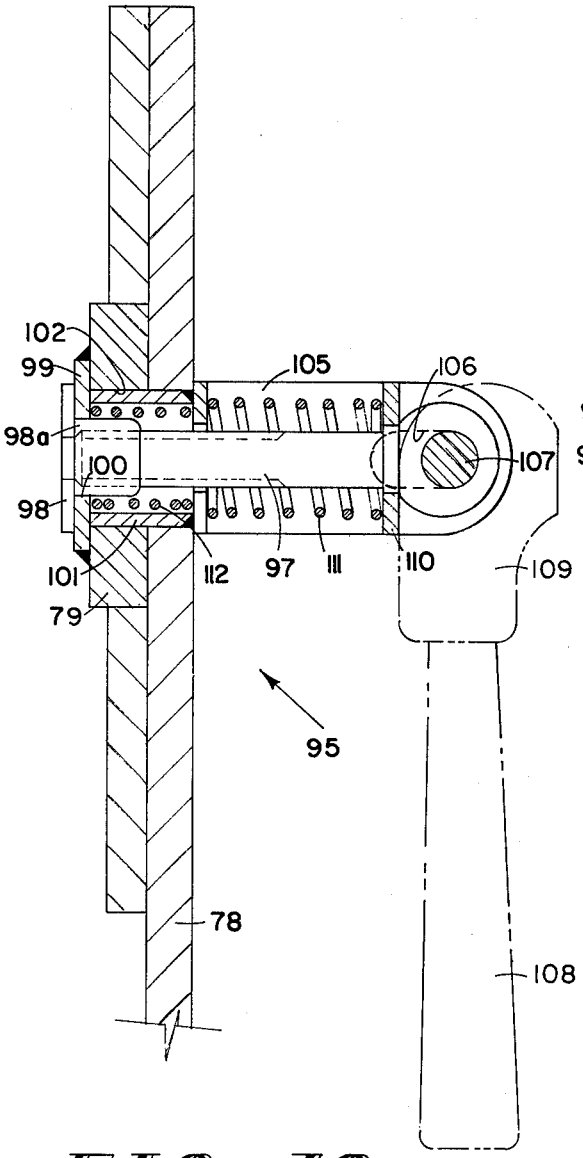

FIG. 10 is a cross-sectional side view of the releasing means in its released position before it is disengaged.

Figure 11:
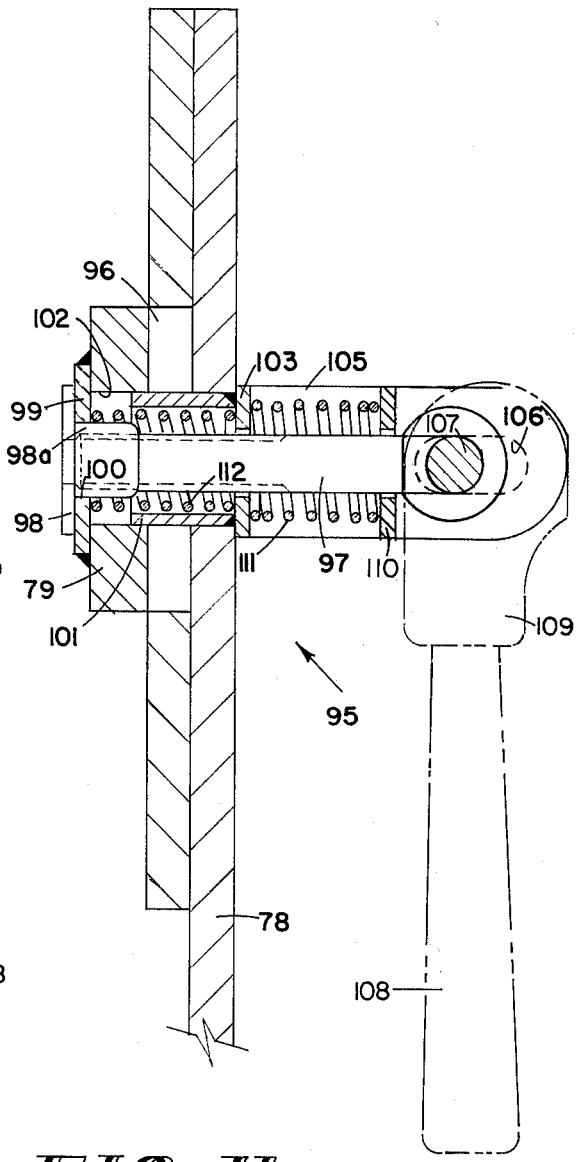

FIG. 11 is a cross-sectional side view of the releasing means in its disengaged position.

Figure 12:
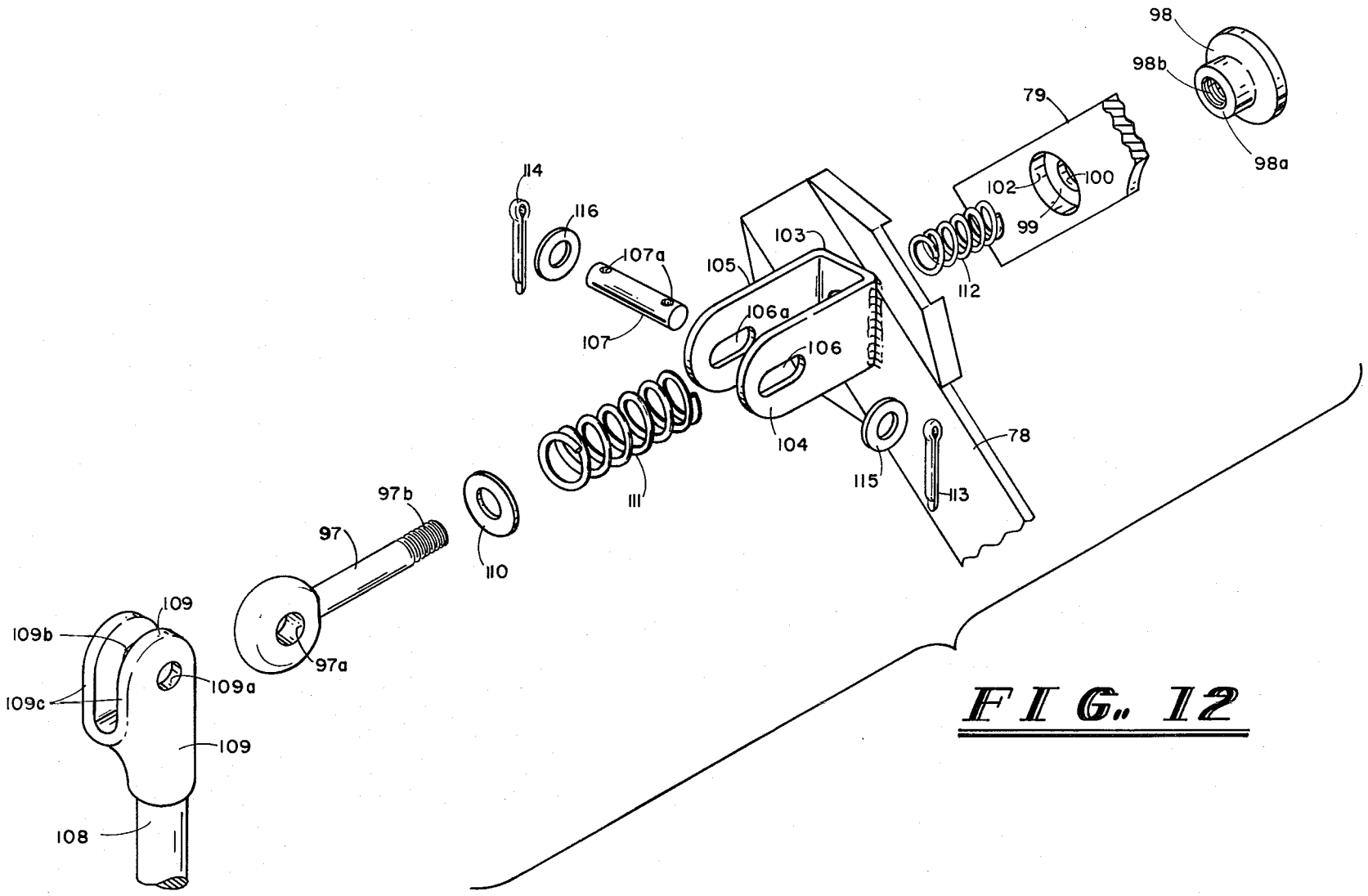

FIG. 12 is a partial exploded view of the releasing means.

BRIEF DESCRIPTION OF THE PREFERRED EMBODIMENT

Figure 1:
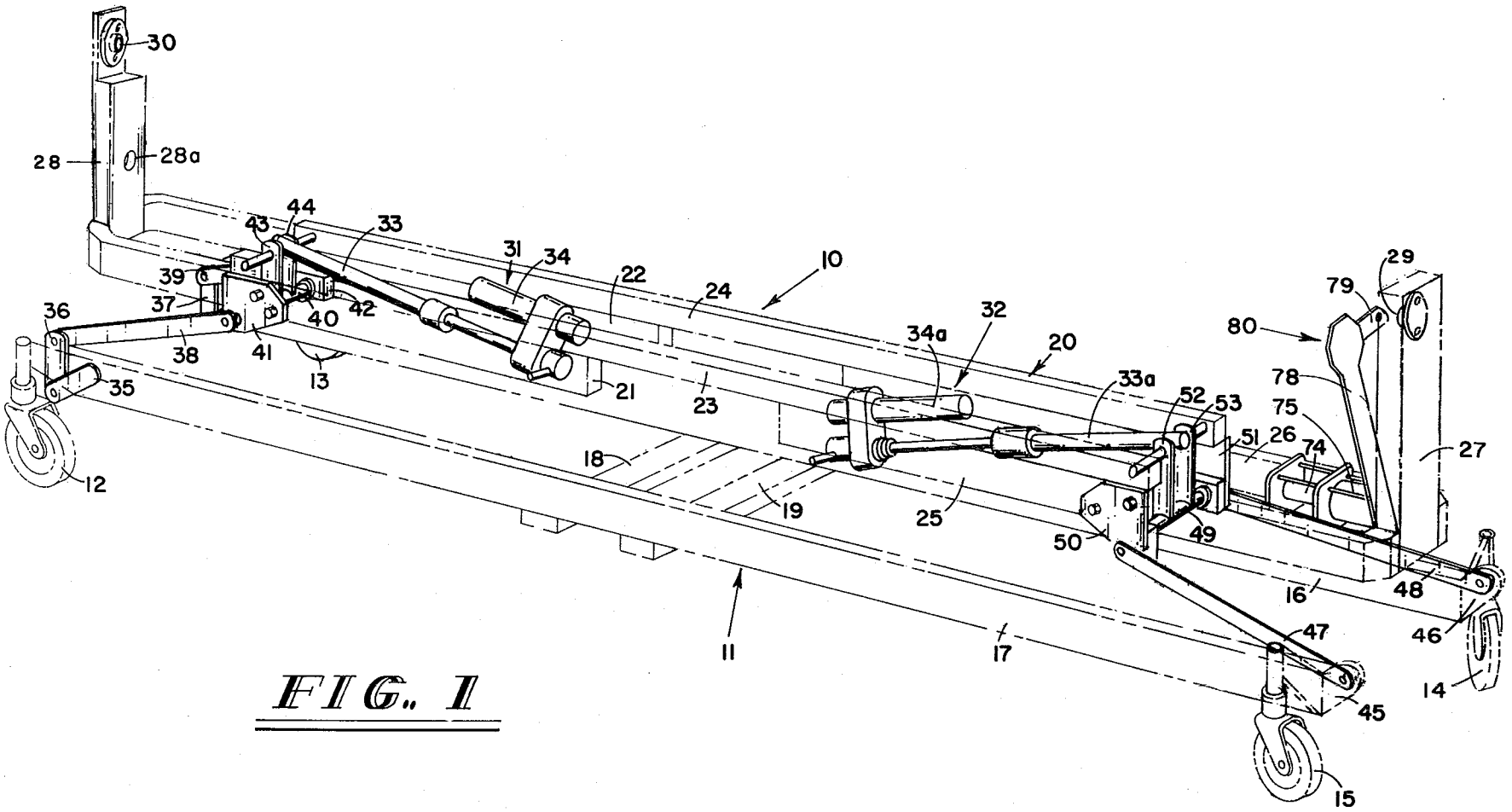
FIG. 1 is a partial view showing the elevating mechanism for the kinetic treatment bed.

Referring to FIG. 1 of the drawing, there is shown the undercarriage 10 of a kinetic treatment bed. In particularly, the undercarriage includes a base 11 which is supported by wheel members 12, 13, 14 and 15 which allow the base and bed to be moved to a desired location. The wheel members may be of the locking type to retain the bed in a stationary position.

The base 11 includes a plurality of longitudially extending and transversely spaced beams 16 and 17 which are secured together by transverse beams 18 and 19. The longitudinal beams 16 and 17 are spaced apart for a reason which will be explained hereinafter.

A bed support means 20 is provided for supporting the patient support platform 54. The bed support means 20 includes a plurality of longitudinally extending beams 21, 22, 23, 24, 25 and 26. At the outer ends of the beams 21 and 22 is mounted an upright support post 28. At the end of beams 25 and 26 is mounted another upright support post 27. A pivot bearing 29 is secured to the upright post 27. Another pivot axis 30 is secured to the upright post 28. Patient support platform 54 which is shown in FIG. 6 is mounted upon these pivot bearings. The patient support platform 54 is pivotally mounted on these pivot bearings 29 and 30 by pivot pins 59 and 58 respectively.

As will be apparent, the beams 21 and 25 are connected by the beam 23 and the beams 22 and 26 are connected by the beam 24. The transverse spacing between the beams 21, 23, 25 and 22, 24 and 26 is such that they may be positioned between the beams 16 and 17. The beams 23 and 24 may rest upon the transverse beams 18 and 19 in their lower most position. As will be apparent, the bed support means 20 may be lowered very close to the ground support through the unique arrangement in spacing of the beams and as a result of the lifting means described below.

As shown in FIG. 1, lifting means 31 and 32 are provided to raise and lower the bed support means 20 relative to the base 11. Lifting means 31 includes a power screw 33 which is driven by an electric motor 34. The lifting means 32 is identical and includes a power screw **33*a* and an electric motor 34*a***. As will be apparent, each of the power screws may be retracted or extended upon actuation of the electric motors which are of the reversable type.

The lifting means 31 as shown in FIG. 1–4 includes a strap 35 which is secured to the beam 17 and another strap **35*a* secured to the beam 16. These straps are secured to these beams by suitable means such as welding. A lever 36 is pivotally attached to the strap 35. Another lever 37 is pivotally attached to the other strap 35*a*. A lever 38 is pivotally attached to the lever 36 and another lever 39 is likewise pivotally attached to the lever 37. The levers 38 and 39 are rigidly connected to a rotating shaft 40 by suitable means such as welding. The shaft 40 is rotatably mounted with support brackets 41 and 42 which are secured to the beam members 21 and 22 respectively. Straps 43 and 44 are rigidly connected to the rotatably mounted shaft 40. The power screw 33 is pivotally mounted with the straps 43 and 44. Since the other end of the power screw 33 is connected with the bed support means 20 actuation of the power screw means which results in its extension or retraction pivots the shaft 40 which in turn translates motion to the levers 36, 37, 38 and 39**.

At the other end of the base 11 and bed support means 20 is another lifting means 32. This lifting means includes straps 45 and 46 which are rigidly secured to the longitudinal beams 17 and 16 respectively. Levers 47 and 48 are pivotally mounted with the straps 45 and 46 respectively. The opposite ends of the levers 47 and 48 are rigidly connected to rotating shaft 49. The rotating shaft 49 is pivotally mounted with brackets 50 and 51 which are rigidly secured to beams 25 and 26 respectively. Straps 52 and 53 are rigidly secured with the rotating shaft 49 to provide rotating motion thereto. One end of the power screw **33*a* is pivotally connected with the straps 52 and 53 and the other end is connected with the bed support means. Accordingly, extension or retraction of the power screw 33*a* will result in pivoting of the shaft 49 and raising and lowering of the bed support means 20. Suitable control switches on a control panel (not shown) are provided to selectively and separately operate the lifting means 31 and 32. Accordingly, the bed support means 20 may be lowered, raised or tilted to provide a desired position for a patient support means which is mounted upon the pivot bearings 29 and 30**.

Figure 2:
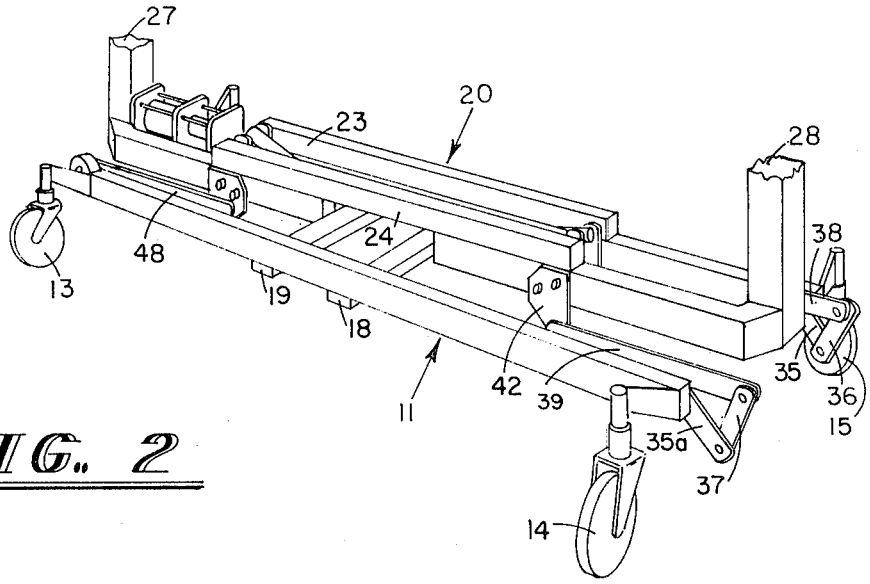
FIG. 2 is a partial view showing the lifting mechanism in its immediate position.
Figure 3:
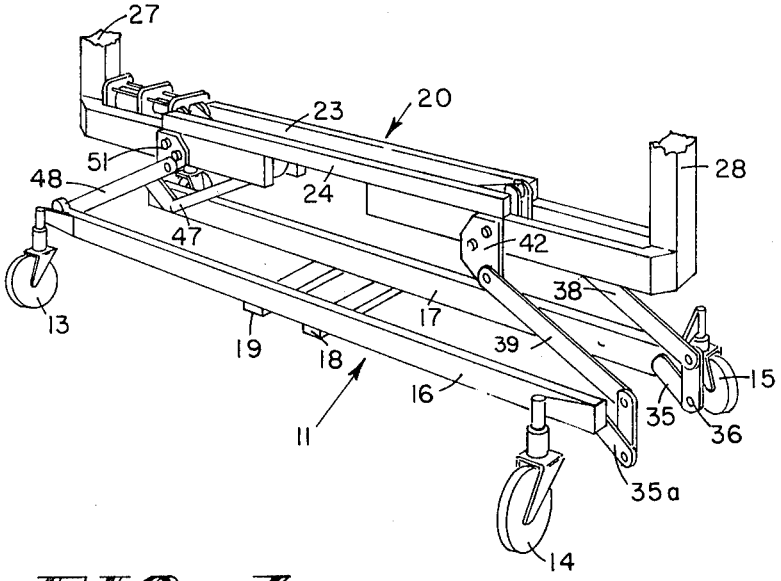
FIG. 3 is a partial view showing the lifting mechanism in its upper-most position.
Figure 4:
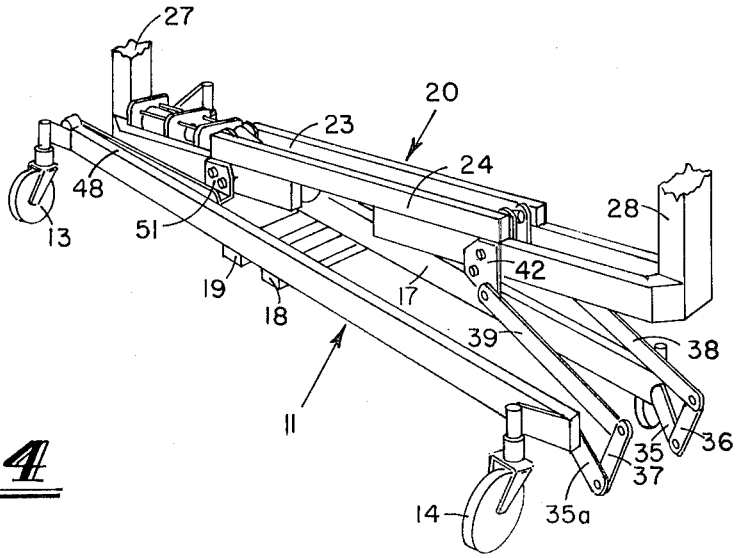
FIG. 4 is a partial view showing the lifting mechanism in a tilted position.

The raising and lowering of the patient support means 20 is shown in FIGS. 2, 3 and 4. As shown in FIG. 2, the bed support means 20 is in an intermediate position between its lower most and upper most positions. As shown in FIG. 3, the power screws 33 and **33*a* are in their fully extended position which raises the bed support means 20 to its upper most position. As shown in FIG. 4, the bed support means is tilted by extending the power screw 33*a* and retracting the power screw 33. This is utilized to position the patient in an inclined position. As discussed above, the bed support means 20 may be lowered such that the beams 23 and 24 rest upon the beams 18 and 19**. In this position a patient (not shown) on a patient support means is closest to the ground support such that that person may be more easily removed from the bed. This is very useful with patients who as part of their treatment are removed from the bed. During removal they can be closely positioned to the ground support such that ease of entry and exit of the bed is made possible. This will facilitate in certain cases the transfer of the patient to a wheelchair or the like. Such transfer may be difficult when the bed cannot be sufficiently lowered so that a person lying thereon can be easily removed and placed in a wheelchair by a single attendant.

Referring to FIG. 6 of the invention, there is shown a patient support platform which may be rotatably mounted on bearings 29 and 30. The patient support platform 54 includes a generally rectangular frame 55 connected to vertical posts 56 and 57. Pivot pins 58 and 59 are secured to the vertical posts 56 and 57 respectively and are adapted to be rotatably positioned upon the pivot bearings 29 and 30 for pivotally mounting the patient support platform 54 on the bed support means 20. Keel means 60 is connected to the vertical support post 56 to provide a counterbalance for the patient support platform. Suitable weights may be positioned on the keel means 60 to prevent overturning of the bed which might cause a patient to fall therefrom.

The patient support platform 54 includes a first support surface 61 which has a hatch means 62. The hatch means 62 allows access to a patient from below the patient when a patient is not easily moved. A second support surface 63 is provided to complete the patient support platform. The second support surface 63 is pivotally mounted relative to the rectangular frame 55 so that it may be raised as shown in FIG. 6 or lowered to a horizontal position whereby it is in the same plane as the first support surface 61. The purpose for pivotally mounting the second support surface 63 is to allow it to be partially raised so that the patient may be raised and inclined in the bed. Secured at one side of the frame 54 is a bracket 64 having a plurality of slots positioned there along. A similar bracket (not shown) is positioned opposite the bracket 64. Levers 66 and 69 are pivotally mounted at one end to the second support surface 63 and a bar 67 as secured at their other end to interconnect them. Bar 67 extends beyond the outer sides of the levers 69 and 66 so that it may be selectively inserted into notches in the brackets such as notch 68 to retain the second support surface in a desired position and angle relative to the first support surface 61.

The second support surface 63 is fixedly mounted to frame member 69 so that pivoting of the second support surface 63 causes rotation of the frame member 69. Strap 70 is rigidly secured to the frame member 69 and a bifurcated bracket 71 is pivotally connected to the strap 70. Rod member 72 is connected to the bifurcated bracket 71 and also connected to sliding pin 72*a*. The pin 72*a* is slidably mounted in a sleeve 73 positioned in the vertical post 56. When the patient support platform 54 is positioned on the bed support means 20, pin 72 extends adjacent the upright post 28 when the upright post 28 and the vertical post 56 are aligned. When the patient support platform 52 is in its horizontal position and the second support surface 63 is in its raised position then the pin 72 is extended whereby it will be inserted in a sleeve 28*a* extending through the vertical post 28 to prevent rotation of the patient support platform 54. This acts as a safety measure to prevent rotation of the bed when the back or second support surface 63 is in the raised position.

Figure 5A:
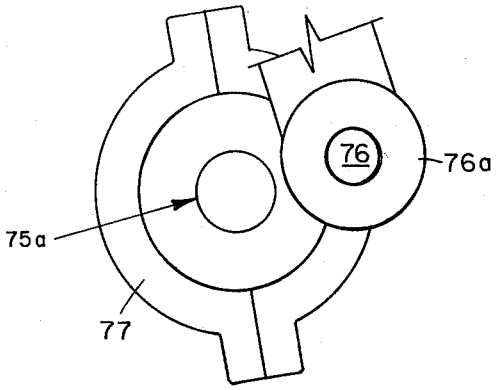
FIG. 5 is a partial view showing the oscillating mechanism of the bed.
Figure 5:
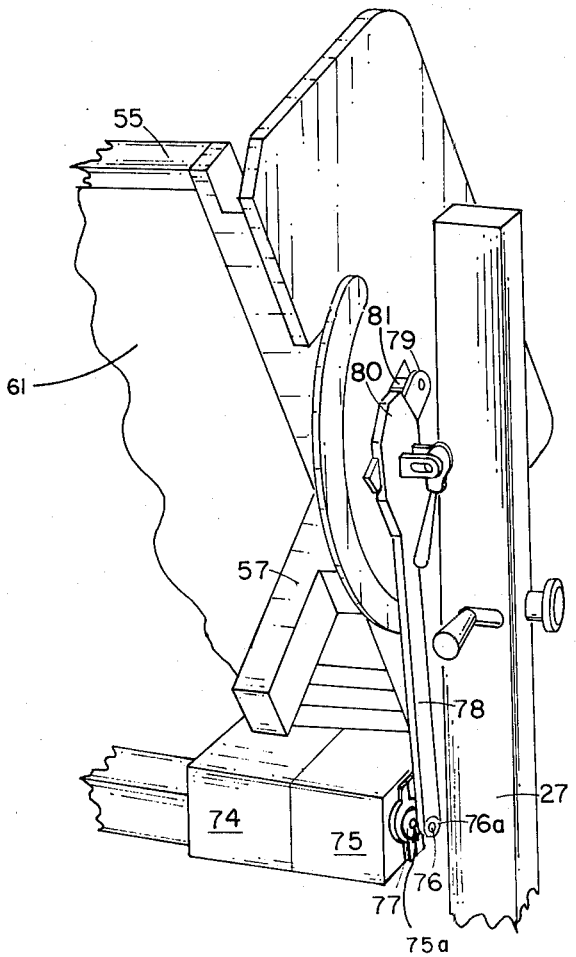

Secured with the bed support means 20 is a drive motor 74 (FIGS. 1 and 5) which provides rotation to the patient support platform 24 so that it will oscillate in a predetermined arc. The drive motor 74 includes a reduction gear box 75 which has a rotating output shaft 75*a* as shown in FIG. 5. Attached to the rotating output shaft 75*a* is a slip clutch 77 which includes journal 76 on which is rotatably mounted portion 76*a* of lever 78. The slip clutch prevents damages to the motor 74 and gear box 75 when it is overloaded and is also used to determine the amount of counterbalancing weight added to the keel. As shown in FIGS. 5 and 5*a*, the shaft 76 is pivotally connected to journal 76*a* on lever 78.

As best shown in FIG. 8, the lever 78 is connected to lever 79 by connecting means 80. The lever 79 is in turn rotatably connected to pin 81 as best shown in FIG. 5. The pin 81 is secured with the patient support platform 54 spaced from the center of rotation of the pivot pin 59. As will be apparent, rotation of the lever 77 will cause reciprocation of the lever 78 which motion will be translated to the lever 79 when the connecting means 80 rigidly connects the levers 78 and 79 in the position as shown in FIG. 8 to provide oscillation of the patient support platform 54.

The arc in which the patient support platform 54 oscillates is determined by the position of the pin 81 relative to the pivot pin 59. As shown in FIG. 6, the pin 81 is eccentrically mounted about another pin 82 which is releasably secured in the pin support bracket 83. As shown FIG. 7, the pin support bracket 83 includes two portions 84 and 85 which compressably hold the pin 82 to prevent its rotation. This is achieved by a screw tightener 86 which may be used to clamp the two portions and prevent the pin 82 from rotating or to release the two portions and allow rotation of the pin 82. Rotation of the pin 82 changes the position of the pin 81 which is rotatably connected with the lever 79. This effects the arc in which the patient support platform 54 rotates.

As shown in FIG. 7, secured to the end of the pin 82 opposite the pin 81 is an adjusting bracket 87. having a plurality of notches 88, 89, 90 and 91. Secured to the upper portion 83 is bifurcated bracket 92 through which extends a pin 93. Pivotally mounted with the pin 93 is a locking member 94 which may be selectively positioned in notches 88, 89, 90 or 91. This is achieved by loosening the screw tightener 86 and rotating the pin 82 to position the notches so that the locking member 94 may be selectively positioned in the notch which is at the position of notch 90 as shown in FIG. 7.

The connecting means 80 is best shown in FIGS. 8, 9, 10, 11 and 12. Referring to FIG. 9, the connecting means 80 includes a releasable locking means 95 which selectively engages and locks the levers 78 and 79 in the position shown in FIG. 8 or releases them as shown in FIG. 11 so that the lever 79 is not rigidly connected to the lever 78. The purpose of the releasable locking means is to allow the patient support platform 54 to be disconnected from the drive motor 74 so that support platform 54 will oscillate independent of the drive motor 74. In its engaged locked position, the lever 79 fits in a slot 96 (FIG. 11). Slot 96 receives the lever 79 as shown in FIGS. 9 and 10 to rigidly lock them together.

The releasable locking means 95 as best shown in FIG. 12 includes an eye bolt 97 having threaded portion 97*b* which is connected to threaded portion 98*b* of end cap 98 which engages member 99 which is rigidly secured to the lever 79. The reduced portion 98*a* of the end cap 98 extends through an aperture 100 in the member 99.

A sleeve 101 is rigidly secured with the lever 78 and extends through the aperture 102 in the lever 79. Lever 79 slides upon the sleeve 101 from its locked position as shown in FIGS. 9 and 10 to its released position as shown in FIG. 11. The eye bolt 97 extends through the sleeve 101 and through bracket 103. The bracket 103 as shown in FIG. 12 is rigidly secured to lever 78 and is bifurcated member with straps 104 and 105. Strap 105 includes a slot 106*a* and the strap 104 also includes an identical slot 106. Slots 106 and 106*a* slidably receive a pin 107 having apertures 107*a*. Cotter keys 113 and 114 and washers 115 and 116 retain the pin 107 in position when it extends through slots 106 and 106*a* and apertures 109*a*, 97*a* and 109*b*. The releasing and engaging lever 108 includes a camming surface 109 and locking surfaces 109*c*, the purposes of which are more fully explained hereinafter. Positioned on the eye bolt 97 is a washer 110. A first spring member 111 is positioned about the eye bolt 97 and to engage bracket 103 and washer 110 to bias the washer 110 against the camming surface 109. A second spring member 112 is positioned about the eye bolt 97 to engage the member 99 and the bracket 103. As will be apparent, the spring 112 acts against the member 99 to bias the lever 79 to the position as shown in FIG. 11. Spring 111 acts to move the lever 78 and 79 to their locking position as shown in FIGS. 9 and 10. The springs 111 and 112 have preselected force values to maintain the releasable locking means 95 in its position as shown in FIG. 9 when the releasing and engaging lever 108 is in its engaged setting and to allow release of the releasable locking means 95 when the lever 108 is moved to the releasing setting as shown in FIGS. 10 and 11. However, the releasable locking means will not allow release of the lever 79 from the lever 78 until patient support platform 54 is in its substantially horizontal rest position and there is no frictional forces being applied to the levers 78 and 79. This is achieved by carefully selecting the forces of the springs 111 and 112 as follows.

When the lever 108 is in its engaged setting as shown in FIG. 9 and the flat locking surfaces 109*c* forces the washer 110 against the spring 111, the spring 111 applies a greater force than does the spring 112. This acts to retain the levers 78 and 79 in engaged or the locked position as shown in FIG. 9. The flat locking surfaces 109c retains the lever 108 in its engaged position.

When it is desired to release the lever 78 and 79 so that the bed will remain in a horizontal position, the lever 108 is moved to the releasing setting as shown in FIGS. 10 and 11. In this case the camming service 109 allows the washer 110 to be moved to the right as shown in FIGS. 10 and 11 to release some of the stored energy in the spring 111. In this position, the spring 112 applies a greater force than does the spring 111. However, the lever 79 is not released from the lever 78 due to the frictional forces between the contacting surfaces of the levers 78 and 79. The frictional forces occur from the weight of the patient support platform 54. Accordingly, the levers 78 and 79 will not be released from each other as shown in FIG. 11 until the patient support platform 54 reaches a substantially horizontal position and no force is being applied to the lever 78 by the lever 79. This always occurs when the patient support platform 54 is in its substantially horizontal position. Accordingly, the lever 109 may be released or engaged when the patient support platform is in any position but it will retain the levers 78 and 79 in their locked position as shown in FIG. 10 until the bed reaches a substantially horizontal position where the spring 112 will cause the lever 79 to pop out of the slot 96. Thereafter reciprocation of the lever 78 will no longer apply any force to the lever 79 since they are allowed to rotate relative to each other about pin member 97.

When it is desired to reconnect the lever 78 and 79 to the locked position as shown in FIGS. 8, 9 and 10, the lever 108 is moved to its engaged setting as shown in FIG. 9. However, the lever 79 will not be positioned into the slot 96 until the levers 78 and 79 are properly aligned during the reciprocating stroke of the lever 78. Accordingly, the releasable locking means 95 can be set to automatically release the levers 78 and 79 and likewise automatically connect them at the horizontal position of the patient support platform when frictional forces are relieved. The operator can also relieve the friction force between the levers 78 and 79 and manually release or connect them at any position. Without the releasable locking means 95, it would be difficult to releasably connect the levers 78 and 79 and this generally would have to be done when the patient support platform 54 was in its substantially horizontal position. It should be understood that the lever 78 moves very slowly so this would require an attendant to wait until the levers 78 and 79 were properly aligned before they were released or reconnected. The releasable locking means 95 allows attendant to engage or disengage the lever 108 at any time so that the levers 78 and 79 will automatically be connected or disconnected as desired. A large amount of physical strength is not required to perform this task notwithstanding the great weight of the bed, particularly with the patient positioned thereon.

Although the invention has been described in conjunction with the foregoing specific embodiment, many alternatives, variations and modifications will be apparent to those of ordinary skill in the art. Those alternatives, variations and modifications are intended to fall within the spirit and scope of the appended claims.

I claim:

1. A therapeutic bed for immobilized patients having an oscillating patient support platform mounted for controlled oscillation about longitudinally extending axes, comprising:

a releaseable locking means connecting a drive means with a patient support platform for controllably oscillating the platform about a longitudinal extending axis thereof;

said releasable locking means having releasing and engaging settings so that it can be placed in either setting at any position of oscillation of the platform to release or engage the drive means and the patient support platform when friction forces acting on the releasable locking means are relieved.

2. The apparatus as set forth in claim 1, wherein:

the releasable locking means includes spring means to release the drive means and the patient support platform when friction forces are relieved.

3. The apparatus as set forth in claim 2, wherein:

the spring means includes two opposed springs having selected force values so that the releasable locking means is retained in its locking position until released and only releases the drive means and the patient support platform when the releasable locking means is released and frictional forces are relieved.

4. The apparatus as set forth in claim 3, wherein:

the releasable locking means includes a camming means to compress and decompress the spring means to place the releasable locking means in its engaging and releasing positions.

5. A therapeutic bed for immobilized patients having an oscillating patient support platform mounted for controlled oscillation about a longitudinally extending axis, comprising:

a motor drive means having a rotating eccentric means rotatably connected to a first lever means;

a second lever means pivotably connected to the oscillating patient support platform;

a releasable locking means for releasably connecting the first and second lever means for controlled oscillation of the platform about a longitudinal extending axis thereof;

said releasable locking means having releasing and engaging settings so that it can be placed in either setting at any position of oscillation of the platform to automatically release or engage the drive means and the patient support platform when in the engaging and releasing position and when friction forces acting on the releasable locking means are relieved.

6. The apparatus as set forth in claim 5, wherein:

the releasable locking means includes spring means to release the drive means and the patient support platform when friction forces are relieved.

7. The apparatus as set forth in claim 6, wherein:

the spring means includes two opposed springs having selected force values so that the releasable locking means is retained in its locking position until released and only releases the drive means and the patient support platform when the releasable locking means is released and frictional forces are relieved.

8. The apparatus as set forth in claim 7, wherein:

the releasable locking means includes a camming means to compress and decompress the spring means to place the releasable locking means in its engaging and releasing positions.

9. A therapeutic bed for immobilized patients having an osillating patient support platform mounted for controlled oscillation about a longitudinally extending axis, comprising:

a motor drive means having a rotating eccentric means rotatably connected to a first lever means;

a second lever means pivotably connected to the oscillating patient support platform;

a releasable locking means for releasably connecting the first and second lever means for controlled oscillation of the platform about a longitudinal extending axis thereof;

said releasable locking means having releasing and engaging settings to release or engage the drive means and the patient support platform when in the engaging and releasing positions.

10. The apparatus as set forth in claim 9, wherein:

the releasable locking means includes spring means to release the drive means and the patient support platform when friction forces are relieved.

11. The apparatus as set forth in claim 10, wherein:

the spring means includes two opposed springs having selected force values so that the releasable locking means is retained in its locking position until released and only releases the drive means and the patient support platform when the releasable locking means is released and frictional forces are relieved.

12. The apparatus as set forth in claim 11, wherein:

the releasable locking means includes a camming means to compress and decompress the spring means to place the releasable locking means in its engaging and releasing positions.

13. A therapeutic bed for immobilized patients having an oscillating patient support platform mounted for controlled oscillation about a longitudinally extending axis, comprising:

a releasable locking means having first and second lever means which are pivotably connected for connecting a motor drive means with a patient support platform for controlled oscillation of the platform about a longitudinal extending axis thereof;

said releasable locking means having releasing and engaging settings so that it can be placed in either setting at any position of oscillation of the platform to automatically release or engage the pivotably connected first and second lever means when friction forces acting on the releasable locking means are relieved.

14. The apparatus as set forth in claim 13, wherein:

the releasable locking means includes spring means to release the drive means and the patient support platform when friction forces are relieved.

15. The apparatus as set forth in claim 14, wherein:

the spring means includes two opposed springs having selected force values so that the releasable locking means is retained in its locking position until released and only releases the drive means and the patient support platform when the releasable locking means is released and frictional forces are relieved.

16. The apparatus as set forth in claim 15, wherein:

the releasable locking means includes a camming means to compress and decompress the spring means to place the releasable locking means in its engaging and releasing positions.

* * * * *